United States Patent [19]

Onoda et al.

[11] Patent Number: 4,798,485

[45] Date of Patent: Jan. 17, 1989

[54] ELECTRONIC TYPEWRITER WITH A DETECTOR SWITCH

[75] Inventors: Hiroshi Onoda, Kariya; Kenji Sakakibara, Ichinomiya; Michitoshi Akao, Nagoya, all of Japan

[73] Assignee: Brother Kogyo Kabushiki Kaisha, Aichi, Japan

[21] Appl. No.: 27,188

[22] Filed: Mar. 17, 1987

[30] Foreign Application Priority Data

| | | | |
|---|---|---|---|
| Mar. 25, 1986 | [JP] | Japan | 61-67523 |
| Mar. 25, 1986 | [JP] | Japan | 61-67524 |
| Jul. 18, 1986 | [JP] | Japan | 61-169999 |

[51] Int. Cl.[4] ..... B41J 29/38

[52] U.S. Cl. ..... 400/54; 400/184; 400/668; 400/690.4; 400/703

[58] Field of Search ..... 400/54, 64, 184, 279, 400/663, 668, 674, 676, 690.4, 703, 713

[56] References Cited

U.S. PATENT DOCUMENTS

| | | | |
|---|---|---|---|
| 4,340,315 | 7/1982 | Teichmann et al. | 400/690.4 |
| 4,357,116 | 11/1982 | Oguchi | 400/184 |
| 4,403,879 | 9/1983 | Vought et al. | 400/54 X |
| 4,557,615 | 12/1985 | Ueno | 400/54 |

FOREIGN PATENT DOCUMENTS

| | | | |
|---|---|---|---|
| 79187 | 6/1980 | Japan | 400/703 |
| 55-93484 | 7/1980 | Japan | 400/54 |
| 24182 | 3/1981 | Japan | 400/184 |
| 71185 | 4/1983 | Japan | 400/54 |
| 33167 | 2/1984 | Japan | 400/54 |
| 48181 | 3/1984 | Japan | 400/54 |
| 59-124881 | 7/1984 | Japan | 400/54 |
| 94379 | 3/1985 | Japan | 400/54 |
| 172575 | 9/1985 | Japan | 400/54 |
| 172576 | 9/1985 | Japan | 400/54 |
| 60-225776 | 11/1985 | Japan | 400/54 |
| 260374 | 12/1985 | Japan | 400/54 |
| 2079678 | 1/1982 | United Kingdom | 400/184 |

OTHER PUBLICATIONS

IBM Tech. Disc. Bulletin, "Print-Carrier Crash Protection", Barrow, vol. 19, No. 9, Feb. 1977, p. 3976.

IBM Tech. Disc. Bulletin, "Cover Section for Paper Opening of a Printer", Mott, vol. 24, No. 8, Jan. 1982, p. 4348.

IBM Tech. Disc. Bulletin, "Single Sensor for Carrier Homing and Print Wheel Identification", Quinn, vol. 25, No. 11A, Apr. 1983, pp. 5818-5819.

*Primary Examiner*—David A. Wiecking
*Assistant Examiner*—James R. McDaniel
*Attorney, Agent, or Firm*—Parkhurst, Oliff & Berridge

[57] ABSTRACT

An electronic typewriter having a single detector switch for detecting whether a lid over a printing mechanism is open or closed and whether a carriage is in the original position or not. The detector switch is stimulated by two stimulators; one being provided on the lid for stimulating the detector switch when the lid is closed, and the other being provided on the carriage for stimulating the detector switch when the carriage is at the original position.

11 Claims, 13 Drawing Sheets

ELECTRONIC TYPEWRITER WITH A DETECTOR SWITCH

BACKGROUND OF THE INVENTION

This invention relates to an electronic typewriter with a single detector switch, which detects if a lid over a printing mechanism of the typewriter is open or closed, and which also detects distinctively if a carriage of the typewriter is at an original position.

A prior art electronic typewriter is provided with two independent switches, one being a carriage original position detector switch on one side of the printing mechanism and the other being a lid open detector switch on the other side thereof for detecting if the lid of the printing mechanism is open. In such a prior art, provision is made to stop the movement of the carriage and the printing motion of a print head after detecting that the lid is open, enabling an operator to exchange a ribbon or a type wheel easily. Here, the original position of the carriage means a predetermined position such as a left extremity of the carriage's mechanical movement. By the detection of the original position, a standard exact position is given from which the print head on the carriage will start printing. The original position of the carriage is detected immediately after the electronic typewriter is turned on and also when the lid, which is once opened for the exchange of the ribbon or the type wheel, is closed again. In these cases, the carriage is moved toward the original position detector switch, and then the original position is set up at the position where the carriage is located when the carriage stimulates the original position detector switch. In such a case that the carriage is moved to the original position after the typewriter is turned on, the carriage is moved for a definite distance from the original position to a predetermined left margin position. On the other hand, in such a case that the carriage is moved to the original position after the opened lid is closed again, the carriage is returned to the memorized position where the carriage was located just before opening the lid. As a result, printing can be always started at a certain position immediately after the typewriter is turned on, and printing can be resumed at exactly the printing position following the previous one when the lid is opened and closed during printing. Thus, uniformly printed lines can be obtained. Such an electronic typewriter is known, for example, from Japanese published unexamined patent applications No. Sho. 59-124881 and No. Sho. 58-71185.

The prior art electronic typewriter, as described above, is provided with different switches for detecting opening and closing of the lid and for detecting the original position of the carriage. Accordingly, it increases the number of the parts, which raises the cost.

SUMMARY OF THE INVENTION

It is accordingly an object of the present invention to provide an electronic typewriter which has fewer parts, lower cost, and improved reliability.

Another object is to provide an electronic typewriter with a switch which can detect distinctively if the lid is open or closed, and if the carriage is at the original position.

A further object of the invention is to provide the above-stated electronic typewriter which can always start printing at a certain position when the typewriter is turned on.

A still further object of the invention is to provide the above-stated electronic typewriter which enables an operator to exchange the printing ribbon or the type wheel easily by opening the lid covering the printing mechanism, and which can resume printing from the appropriate position without intentional operation even if the operator carelessly moves the carriage while exchanging the ribbon or the type wheel, by returning the carriage to the next exact printing position when the lid is closed again.

It is insufficient to devise a common detector switch for detecting the opening of the lid and for detecting the original position of the carriage, for it is impossible to judge which condition stimulates the detector switch. For example, there are cases when the electronic typewriter is tunred on with the lid open, and when the operator moves the carriage to the original position while the lid is open. Especially in the latter case, that is, when the operator moves the carriage to the original position with the lid open, the normal key operation is impossible even after the lid is closed, for the detector switch remains in the same state as before the lid was closed because the carriage is at the original position. Therefore, the operator has to turn off the typewriter and then turn it on again so as to resume printing after the lid is closed. This operation causes the problem that text data stored in the memory not backed-up by a battery are erased.

Therefore, the objects of the invention are attained by an electronic typewriter with a keyboard, a frame, a carriage relatively movable along a platen installed in the frame, and a lid for operatively covering the frame which includes: a detector switch provided on the frame alternatively being in a first state or a second state; a first stimulator provided on the lid for changing the detector switch to the first state when the lid is closed and for changing the detector switch to the second state when the lid is opened; a second stimulator provided on the carriage, and being shiftable between a normal rest position and a shifted position, for changing the detector switch to the second state when the carriage is at an original position along the platen and the second stimulator is in the shifted position and for changing the detector switch to the first position otherwise; and means for shifting the second stimulator from the normal rest position to the shifted position if the detector switch is in the first state after the typewriter is turned on or when the lid is closed after once opened.

The objects are also attained by an electronic typewriter with a keyboard, a frame, a carriage relatively movable along a platen installed in the frame, and a lid for operatively covering the frame which includes: a detector switch provided on the frame alternatively being in a first state or a second state; a first stimulator provided on the lid for stimulating the detector switch to the first state when the lid is closed; a second stimulator provided on the carriage for stimulating the detector switch to the second state when the carriage is at an original position along the platen; and means for moving the carriage to a position where the second stimulator cannot stimulate the detector switch to the second state when the detector switch is stimulated to the second state after the typewriter is turned on.

BRIEF DESCRIPTION OF THE DRAWINGS

The present invention will be described in more detail with examples and reference to the accompanying drawings. A first and a second embodiments are illustrated according to FIGS. 1 through 9 wherein.

Figure 10:
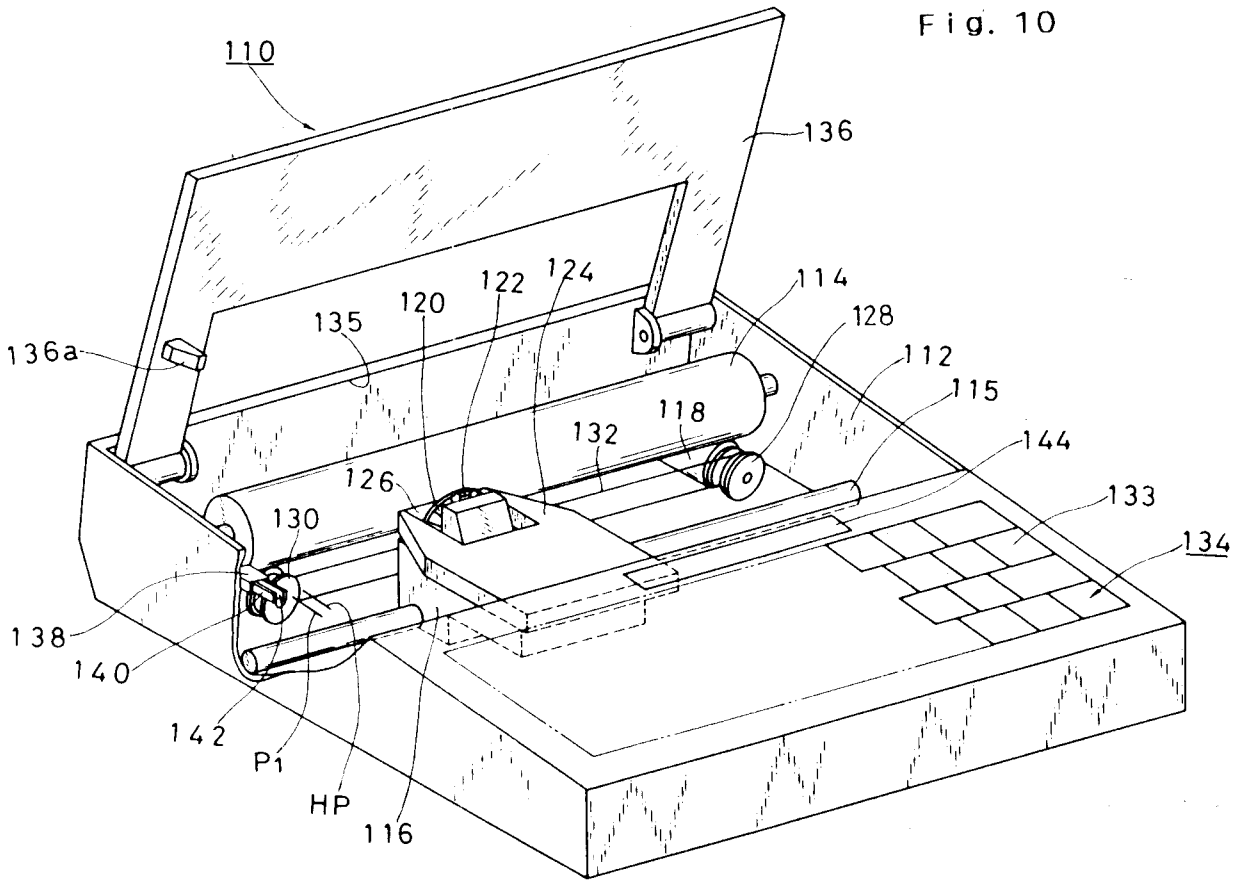
Figure 11:
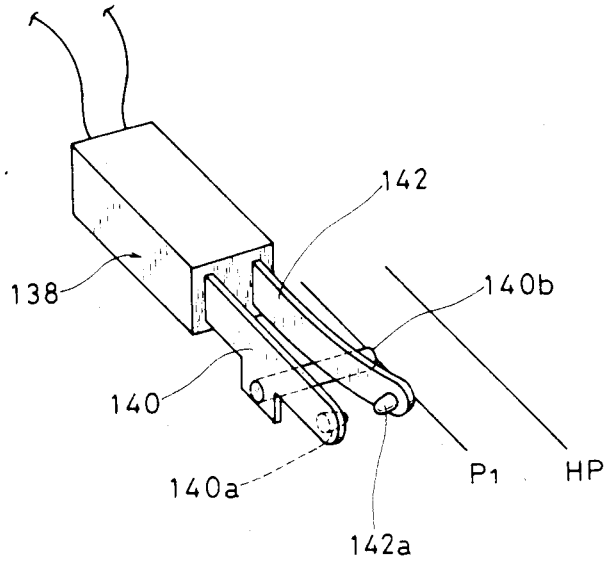
Figure 12C:
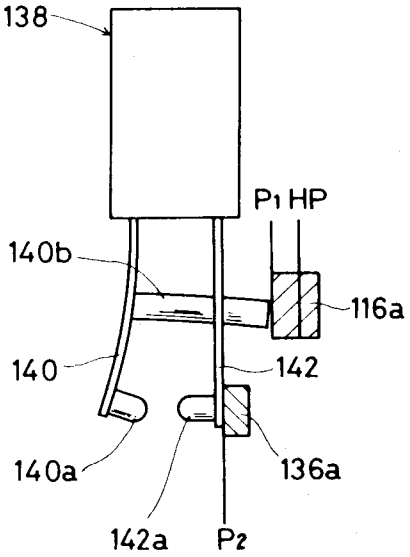
Figure 12B:
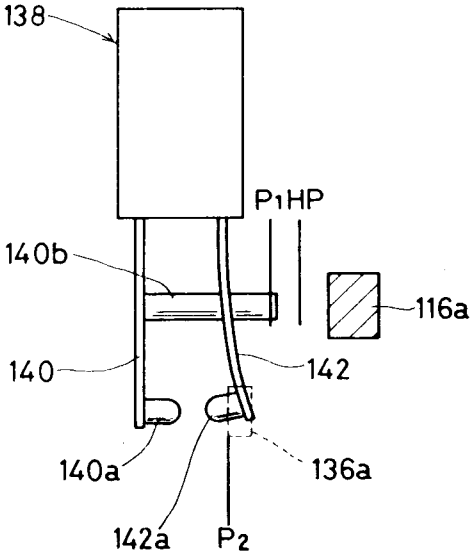
Figure 12A:
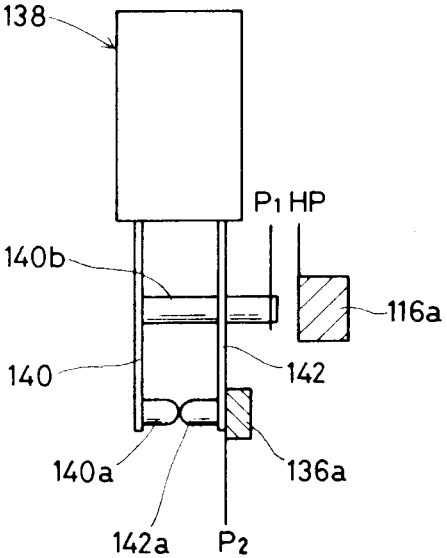
Figure 13:
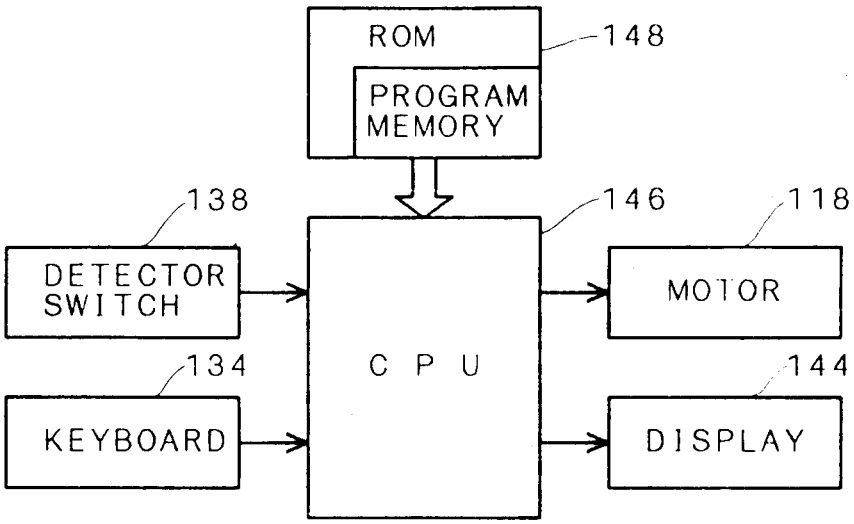
Figure 14:
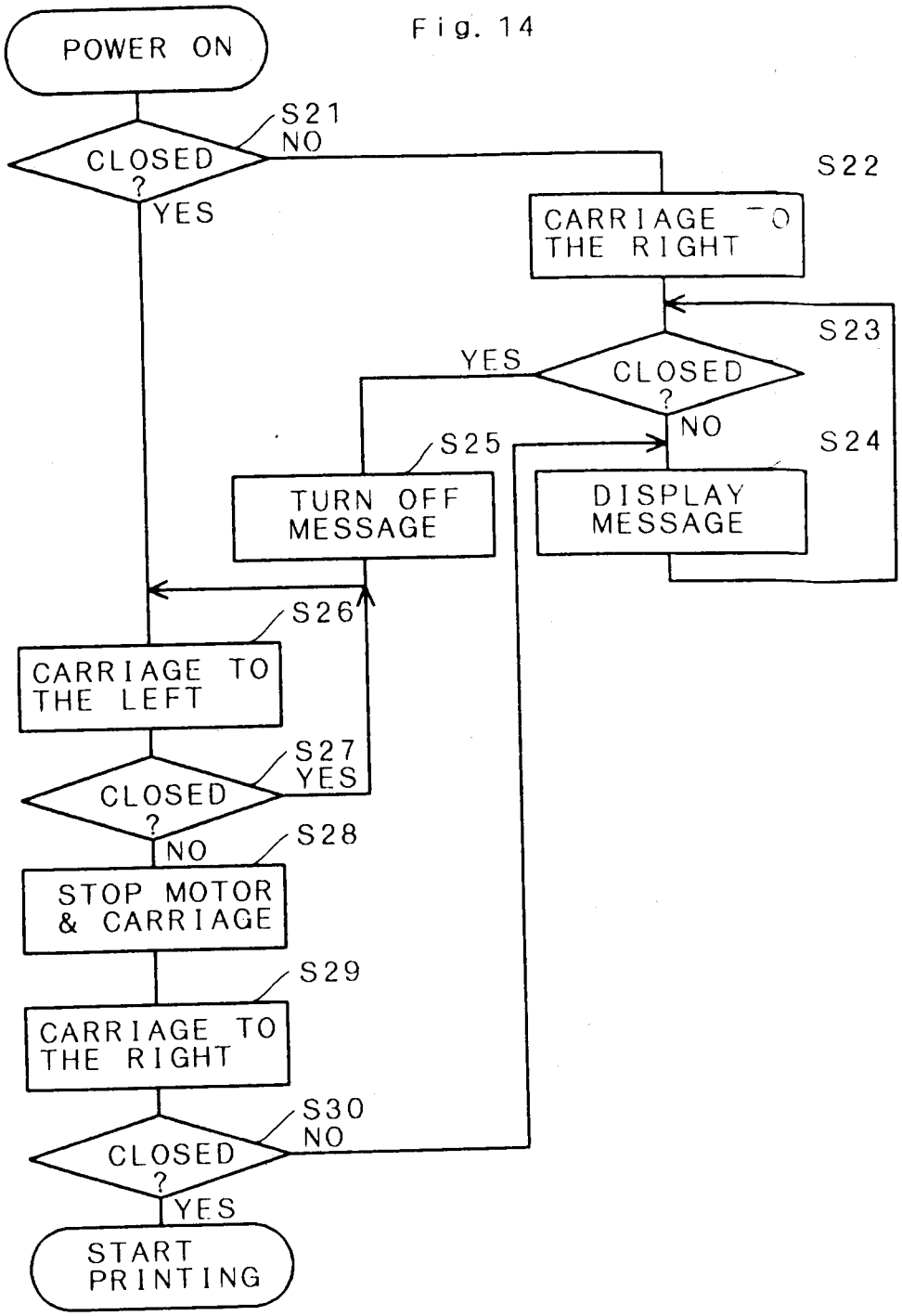

The third embodiment is illustrated according to FIGS. 10 through 14 wherein:

FIG. 10 is a partially broken perspective view of an electronic typewriter embodying the invention;

FIG. 11 is a schematic perspective view of a switch mechanism of the typewriter;

FIGS. 12A, 12B and 12C are schematic plan views illustrating the function of the switch mechanism of FIG. 11;

FIG. 13 is a block diagram of an electric control system in the typewriter; and FIG. 14 is a flow chart of the third embodiment.

DETAILED DESCRIPTION OF THE PREFERRED EMBODIMENTS

Figure 2:
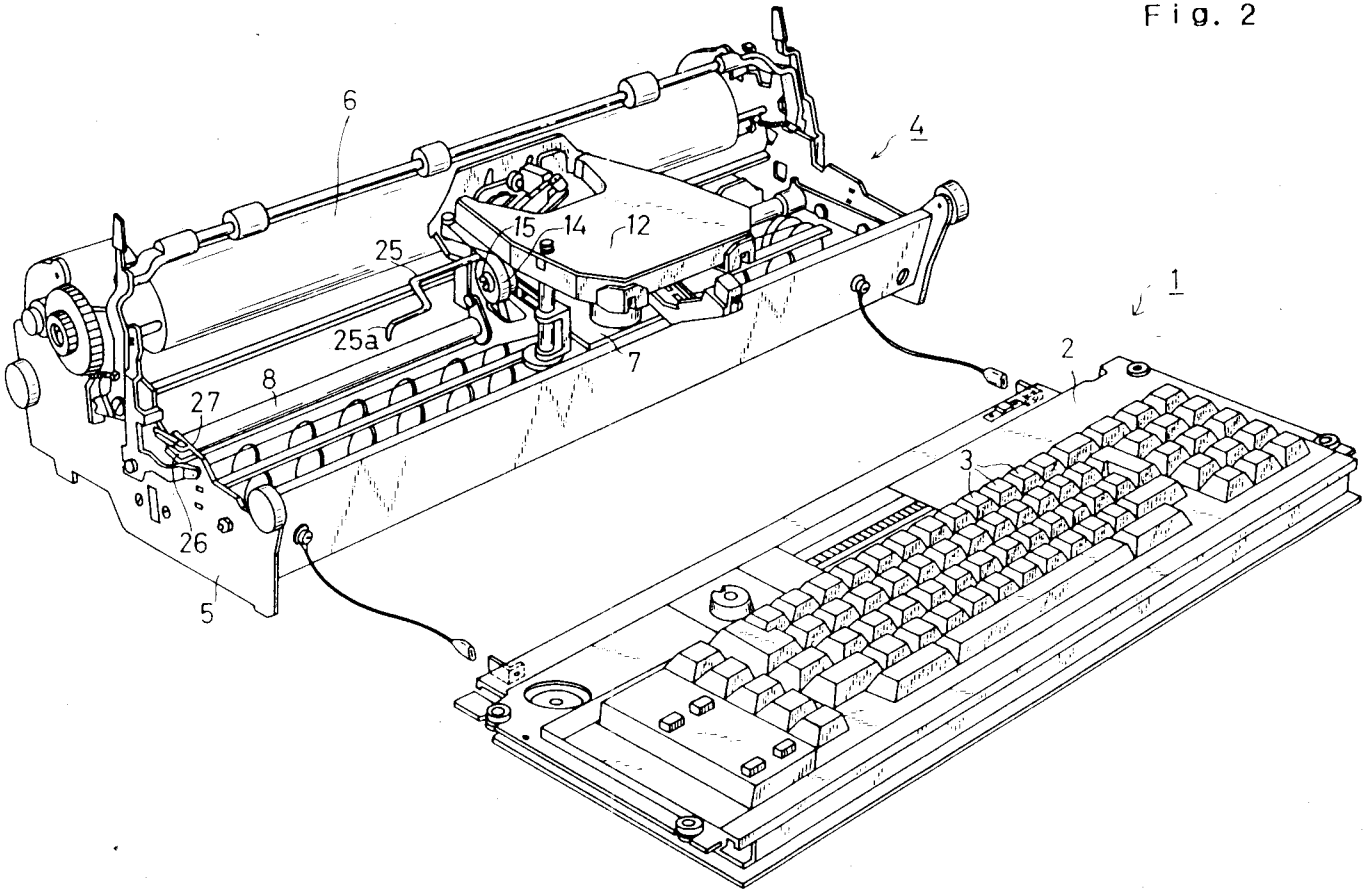
FIG. 2 is a perspective view of an electronic typewriter embodying the invention.

An electronic typewriter embodying the present invention will be described in detail hereinafter according to the drawings. Referring to FIG. 2, an electronic typewriter 1 has a multiplicity of character keys 3 and various function keys on a keyboard 2. A printing device 4 is provided at the rear of the keyboard 2. A platen 6 is rotatably installed in a frame 5 of the printing device 4. A carriage 7 is supported movably along a guide shaft 8 which is provided parallel to the platen 6 between both sides of the frame 5. The carriage 7 can be moved laterally back and forth by means of a carriage driving mechanism not shown.

Figure 3A:
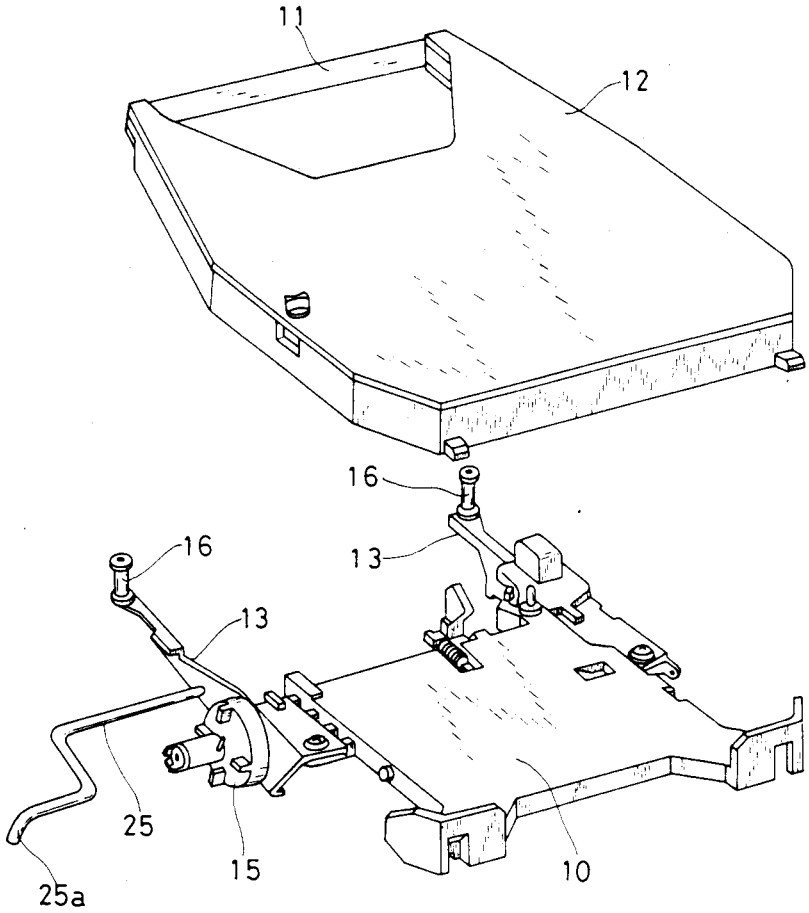
FIGS. 3A and 3B show perspective views of a holder and a ribbon cassette removed from the electronic typewriter.
Figure 4:
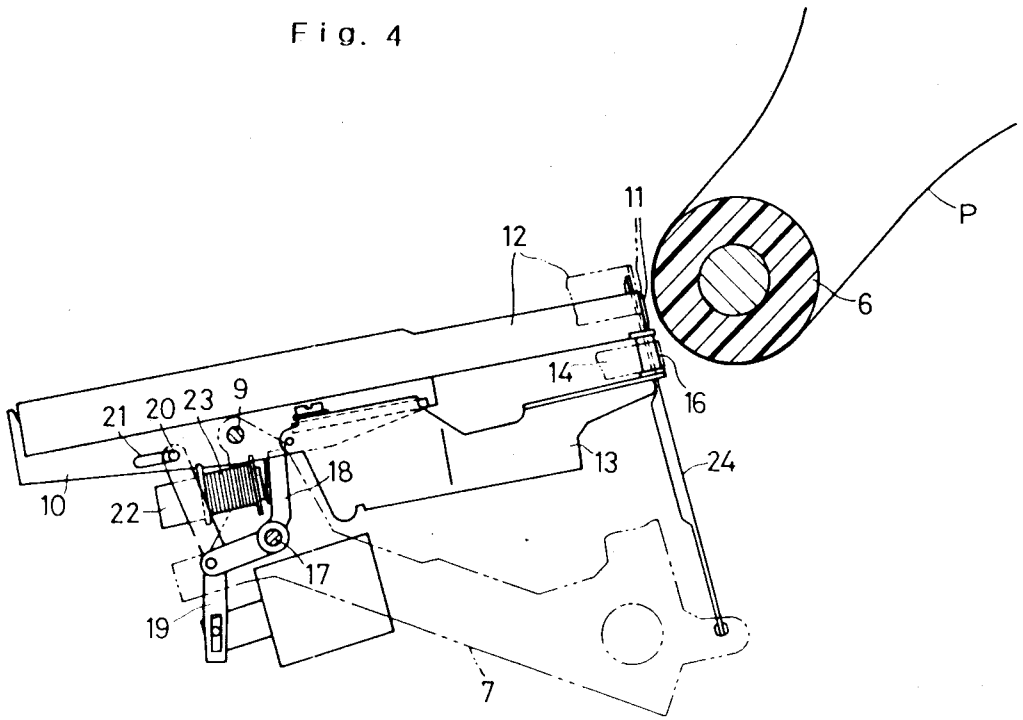
FIG. 4 is a side view of a carriage.

As shown in FIG. 4, a supporting shaft 9 is secured within the front upper part of the carriage 7. At the central part of the supporting shaft 9, a holder 10 is supported to be shifted vertically. A ribbon cassette 12 containing a printing ribbon 11 is removably mounted on the upper surface of the holder 10. The printing ribbon 11 running through the ribbon cassette 12 has an exposed portion which faces the platen 6. As shown in FIGS. 3A and 4, correction ribbon holders 13 are attached at both sides of the holder 10 to project towards the platen 6. A take-up spool (not shown) for taking up a correction ribbon 14 and a supply spool 15 for supplying the correction ribbon 14 are rotatably attached to the correction ribbon holders 13. Guide rollers 16 for guiding the correction ribbon 14 are provided on the ends of the upper surfaces of the correction ribbon holders 13 so that the correction ribbon 14 is opposed to the platen 6 below the printing ribbon 11 as shown in FIG. 4.

A shifting shaft 17 is held within the carriage 7 below the supporting shaft 9. An L-shaped first lever 18 is supported at its center rotatably around the central part of the shifting shaft 17. The first lever 18 is normally positioned as shown in FIG. 4. A second lever 19 is supported at one end of the first lever 18 movably between the rest position shown in FIG. 4 and the printing position. An engaging pin 20 projects from one end of the second lever 19. A slot 21 is located longitudinally on the side surface of the holder 10. The engaging pin 20 of the second lever 19 is received by the slot 21. The slot 21 functions as a cam groove for the engaging pin 20 which rotates around the shifting shaft 17. The combination of the slot 21 and the engaging pin 20 constitutes a coupling mechanism for movably coupling the second lever 19 and the holder 10.

An electromagnet 23 which has a core 22 and a coil wound thereon is attached to the carriage 7 opposite to the upper part of the first lever 18. The electromagnet 23 functions as the ribbon lift mechanism and also as the shifting mechanism of a stimulator as mentioned later. When any of the character keys 3 is pressed or when the stimulator is required to be shifted up, the electromagnet 23 is energized to attract the upper part of the first lever 18. As a result, the first lever 18 rotates counterclockwise and the second lever 19 is moved downward. The holder 10 rotates counterclockwise on the supporting shaft 9 to lift the ribbon cassette 12 into the printing position shown by a double-dash interrupted line. The printing ribbon 11 and a daisy type wheel 24 whose operation depends on pressing of the character keys 3 both cooperate to print a desired character on a printing paper P set on the platen 6.

As shown in FIG. 3A, a stimulator arm 25 for indicating if the carriage is in its original position projects from the side surface of the correction ribbon holder 13 attached to the left side of the holder 10. A tip **25*a* of the stimulator arm 25** is bent downward in an arc.

Figure 1:
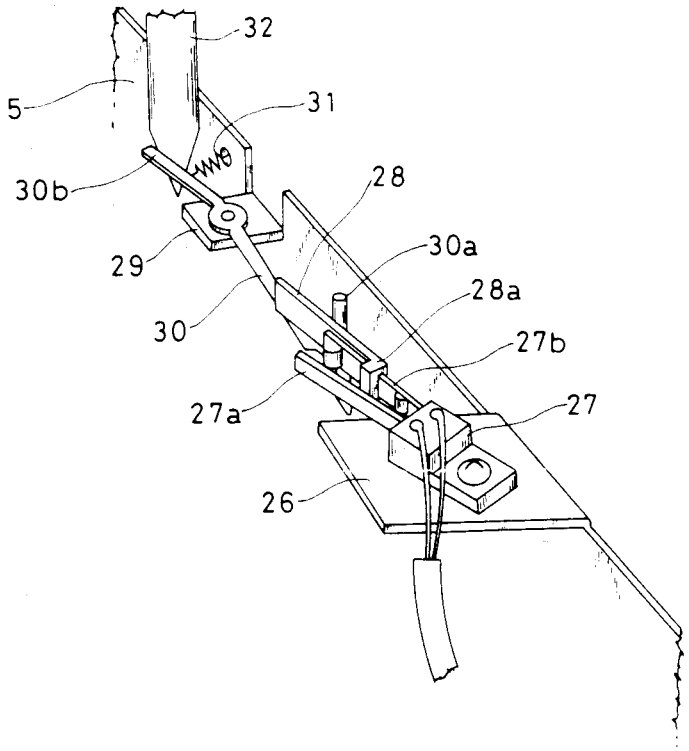
FIG. 1 is a perspective view of the main portion of the embodiments of the invention.

Referring to FIG. 2 again, a switch fixture 26 projects from the left external side surface of the frame 5. A detector switch 27 is fixed on the switch fixture 26. Referring to FIG. 1 for further details, an immovable contact **27*a* and a resilient movable contact 27*b* of the detector switch 27 extend backward and are normally positioned apart from each other. A base portion 28*a* of a strip 28 is attached to the movable contact 27*b*. The opposite end of the strip 28 is positioned so as to be pressed by means of the tip 25*a* of the stimulator arm 25 whenever the carriage 7 is returned to the original position providing that the holder 10 shown in FIG. 3A** is in the printing position.

A supporting tab 29 projects from the left external side surface of the frame 5 at the rear of the switch fixture 26 thereon. A working lever 30 is pivotally attached at its center to the supporting tab 29. The working lever 30 extends forward and forms and L-shaped end **30*a* thereon in such a position that the end 30*a* can be brought into contact with the center of the strip 28. On the other hand, the working lever 30 extends backward from the pivot and forms another end 30*b*. A tension spring 31 is attached to the frame 5 at one end and to the end 30*b* of the working lever 30 at the other end so as to restrain the end 30*b* of the working lever 30 towards the frame 5 and accordingly to push the strip 28 with the other end 30*a*, closing the contacts 27*a* and 27*b*. A lid (not shown) covers the printing device 4 to be opened and closed thereon. A projection 32 projects downward from the lid. When the lid is closed, the projection 32 is inserted between the end 30*b* of the working lever 30 and the frame 5, and then the end 30*a*** of the working lever 30 is held away from the strip 28 against the tension force of the tension spring 31, opening the contacts 27a and 27b.

Figure 7:
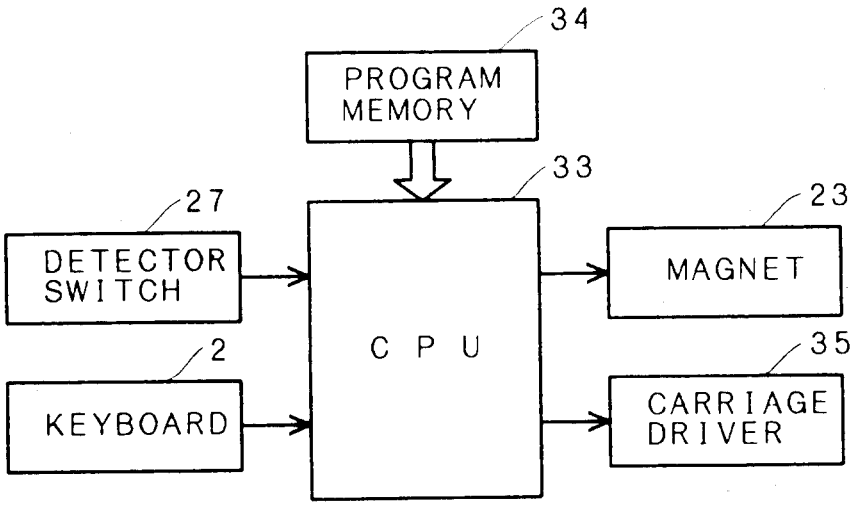
FIG. 7 is a block diagram of an electric control system in the electronic typewriter.

The electric control section of the electronic typewriter 1 will be described hereinafter according to FIG. 7. A central processing unit (CPU) 33 is connected with a program memory 34. The CPU 33 processes steps according to control programs stored in the program memory 34 in order to drive the electromagnet 23, a carriage driving mechanism 35, and so forth for printing. During normal printing, the CPU 33 controls the carriage driving mechanism 35 in such a manner that the carriage 7 is both within a printing range in which the carriage can be moved while printing, and also a definite distance apart from the carriage's original position. The original position of the carriage 7 is a standard position for the carriage 7 to be moved therefrom to a desired position in starting or resuming printing. As a result, the stimulator arm 25, during normal printing, is apart from the detector switch 27. Since the lid is closed here, the contacts 27a and 27b of the detector switch 27 are open, that is, the detector switch 27 is OFF. The detector switch 27 is connected with the CPU 33.

Figure 8:
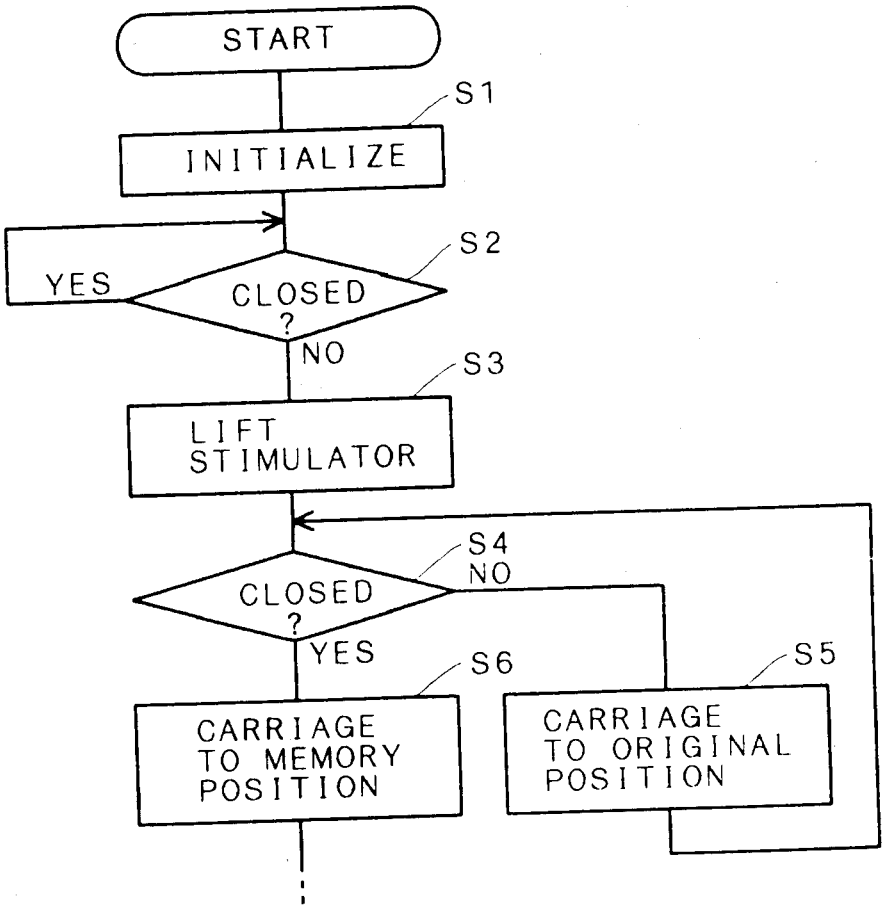
FIG. 8 is a flow chart of the first embodiment.

The functions of the above-mentioned electronic typewriter 1 when turned on will be described according to FIG. 8 illustrating the flow chart of the program which the CPU 33 processes in starting. When the routine of this program beings, various operations for initialization are made at step S1 and then it is determined at decision point S2 whether the detector switch 27 is closed. If the answer is YES, the determination at decision point S2 repeats until the detector switch 27 is opened.

Figure 5:
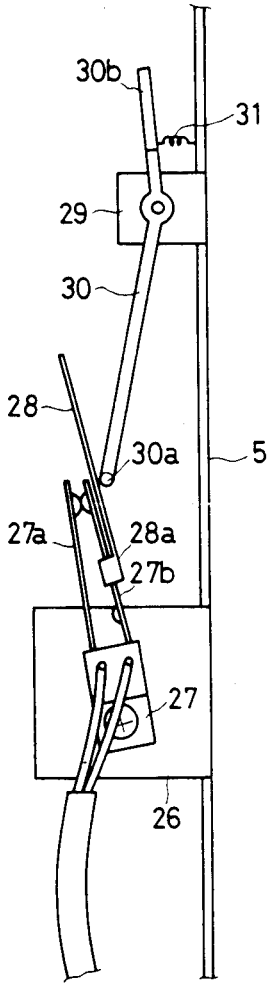
FIGS. 5 and 6 are plan views showing the function of the detector switch with its main portion.

If the typewriter 1 is turned on with the lid open, the projection 32 of the lid is held away from the end 30b of the working lever 30 and the frame 5 as shown in FIG. 5 so that the detector switch 27 is closed by the contracting force of the spring 31. Therefore, the CPU 33 at decision point S2 determines YES. At this stage, the CPU 33 has not energized the electromagnet 23 yet since it is immediately after the typewriter 1 has been turned on. Thus, the holder 10 and the tip 25a of the stimulator arm 25 attached thereon are below the printing position; that is, the tip 25a is not positioned sufficiently high to be detected by the detector switch 27. As a result, it is determined that the detector switch 27 is closed because the lid is open, and then the CPU 33 waits at decision point S2 until the lid is closed so as to open the detector switch 27. Alternatively, if the typewriter is turned on with the lid closed, the program proceeds from decision point S2 to step S3 immediately since the detector switch 27 is already open.

Figure 6:
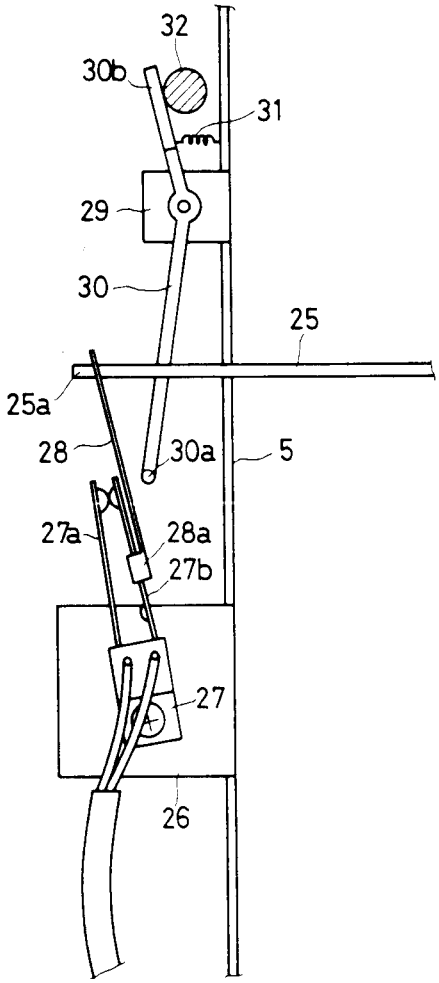

At step S3 the CPU 33 energizes the electromagnet 23 so as to lift the holder 10 and the tip 25a of the stimulator arm 25 attached thereon. Accordingly, the tip 25a is positioned sufficiently high to be detected by the detector switch 27. Thereafter, the program proceeds to decision point S4 where it is determined again whether the detector switch 27 is closed. If the answer is NO, it means that the carriage 7 is not at the original position because the detector switch 27 is still open even after the tip 25a of the stimulator arm 25 was lifted at step S3. Therefore, the program proceeds to step S5 where the CPU 33 drives the carriage 7 towards the original position, that is, leftward in FIG. 2, and the program returns to decision point S4. The steps S4 and S5 are repeated in order to move the carriage 7 until the detector switch 27 is closed. When the carriage 7 reaches the original position where the tip 25a of the stimulator arm 25 closes the detector switch 27 as shown in FIG. 6, the answer of decision point S4 is YES and the program proceeds to step S6. At step S6 the CPU 33 drives the carriage 7 to a determined position from the original position. Here, the determined position means a stored position in the memory. In such a case that the typewriter 1 is turned on, the predetermined left margin position is stored in the memory at the initialization (step S1). In such a case that the lid is opened while the typewriter 1 is operated, on the other hand, the position of the carriage 7 at the moment is stored in the memory. After step S6 the electronic typewriter 1 functions as determined according to pressing of various keys.

As described above, when the electronic typewriter 1 of the first embodiment is turned on with the lid open, the program waits at decision point S2 until the lid is closed. When the typewriter 1 is turned on with the carriage 7 located at the original position, on the other hand, the tip 25a of the stimulator arm 25 attached to the holder 10 is not positioned sufficiently high to be detected by the detector switch 27 yet and the detector switch 27 remains open. In the latter case, the program proceeds to steps S1, S2, and S3 where the detector switch 27 is closed, and then to S4 where YES is determined, and finally to step S6 for preparing normal operations on the typewriter.

Alternatively, when the lid is opened while the typewriter 1 is operating, the CPU 33 stores in the memory the position of the carriage 7 at the moment and the program jumps to just before decision point S2. Since the carriage 7 cannot be located at the original position at this stage, the CPU 33 determines by the detector switch 27 that the lid is opened. The CPU 33 waits at decision point S2 until the lid is closed, for example, after the operator finishes exchanging the printing ribbon or the type wheel. The process after the lid is closed is the same as previously described. Even if the operator moves the carriage 7 to the original position while the lid is open, it is the same as the case when the typewriter 1 is turned on with the carriage 7 at the original position; that is, the CPU can determine whether the detector switch 27 is closed by the lid being open or by the carriage 7 being located at the original position. Thus, the typewriter 1 can be operated properly after the above mentioned process.

In order to facilitate the exchange of the ribbon and the type wheel, it may be possible to either make the pressing of various keys inoperative, or to move the carriage 7 to the central portion along the platen 6 when the operator opens the lid while typing. After the lid is closed, the carriage 7 in these cases is also returned to the predetermined position stored in the memory according to the above-mentioned process so that printing is resumed in succession.

In the above stated first embodiment, the printing ribbon lift mechanism is employed for moving the stimulator arm on the carriage. However, a detector mechanism and its stimulator may be designed in other ways, such as:

(a) A correction ribbon lift mechanism is employed for moving the stimulator on the carriage;

(b) An exlusive lift mechanism for the stimulator on the carriage is employed;

(c) A detector mechanism and its stimulator consist of either an optical method or a magnetic method, for example, a light-emitting diode as the stimulator and a light-receiving element as the detector mechanism; and (d) The stimulator on the carriage is designed so as to move horizontally right and left or back and forth rather than vertically.

Figure 3B:
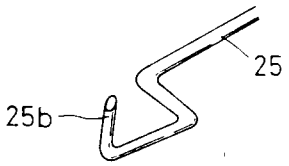
Figure 9:
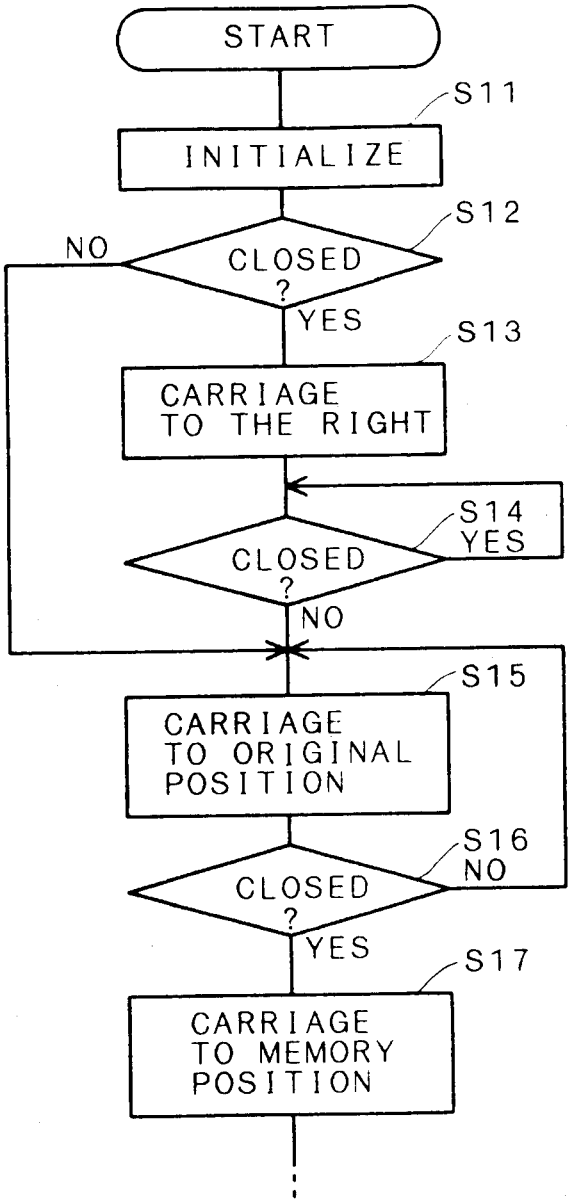
FIG. 9 is a flow chart of the second embodiment.

Hereinafter the second embodiment of the present invention will be described where a detector switch detects distinctively the lid being opened and the carriage being at the original position by means of a displacement of the carriage other than by means of a displacement of the stimulator described in the first embodiment. A mechanical design of the second embodiment is the same as the first embodiment. However, the difference is, as shown in FIG. 3B, that the tip 25*b* of the stimulator arm 25 is arranged so as to be detected by the detector switch 27 even when the holder 10 is below the printing position, that is, when the electromagnet 23 has yet to be energized. The program of the CPU 33 in the second embodiment will be explained according to the flow chart in FIG. 9.

When the electronic typewriter 1 is turned on, various operations for initialization are made at step S11 and then it is determined whether the detector switch 27 is closed at decision point S12, in the same manner as the first embodiment. If the detector switch 27 is closed at decision point S12, it means that the lid is open or that the carriage 7 is at the original position. At this stage, however, it is impossible to determine which factor closes the detector switch 27. If the answer is YES at decision point S12, the program proceeds to step S13 where the carriage 7 is moved to such a position where the carriage 7 is not detected by the detector switch 27. More exactly, the carriage 7 is moved a definite distance rightward as in FIG. 2. At decision point S14 it is determined again whether the detector switch 27 is closed. If the answer is NO, it means that the lid is closed considering the fact that the carriage 7 has already moved at step S13 to the position where it is not detected by the detector switch 27. On the other hand, if the answer is YES at decision point S14, it means that the lid is open and the CPU 33 repeats the determination at decision point S14 and waits for the lid to be closed. After the lid is closed, the program proceeds to steps S15 and S16 for positioning the carriage 7 in the same manner as the first embodiment; that is, the carriage 7 is moved leftward in FIG. 2 until it is detected at decision point S16 that the carriage 7 has reached the original position. At the moment the carriage 7 reaches the original position, the program proceeds to step S17 where the carriage 7 is moved to the determined position stored in the memory.

If it is determined that the detector switch 27 is open at decision point S12, on the other hand, it means exclusively that the lid is closed and that the carriage 7 is not at the original position. Therefore, the program proceeds to steps S15, S16 and S17 for properly positioning the carriage 7 and preparing normal operations on the typewriter.

The second embodiment is designed as described above. When the typewriter 1 is turned on with the carriage 7 at the original position, the detector switch 27 is closed and accordingly the program proceeds to steps S11, and S12, and S13 where the carriage 7 is moved rightward away from the original position. If the lid is closed here, the detector switch 27 is open and the program proceeds to steps S15, S16 and S17. Conversely, if the lid is opened, the CPU 33 repeats the determination at decision point S14 until the lid is closed. After the lid is closed, the program proceeds to steps S15, S16 and S17 for properly positioning the carriage 7. Alternatively, when the typewriter 1 is turned on with the lid open and the carriage 7 away from the original position, the detector switch 27 is closed and accordingly the program proceeds to steps S11, S12, S13 and S14 where it waits for the lid to be closed. After the lid is closed, the program proceeds to steps S15, S16 and S17 for properly positioning the carriage 7.

Even when the lid is opened while the typewriter 1 is operated in the second embodiment, the program proceeds similarly to the first embodiment, that is: the CPU 33 stores in the memory the position of the carriage 7 at the moment and moves the carriage 7 to the central portion along the platen 6 for convenience of the ribbon or type-wheel exchange operation, and the program thereafter jumps to just before decision point S14 followed by the same processing steps as the above cases that the typewriter 1 is turned on.

In the above mentioned second embodiment, the stimulator arm 25 for detecting the carriage's original position is designed, for convenience of explanation, for attachment on the holder 10. However, the stimulator arm 25 may not necessarily be attached to the holder 10 which shifts up and down and it may be attached to the carriage 7 itself. In such a case, it is naturally required to attach the stimulator arm 25 in such a position of the carriage 7 that the stimulator arm 25 can be detected by the detector switch 27 when the carriage 7 is in the original position.

Hereinafter a different type of an electronic typewriter from that illustrated in the first and second embodiments will be explained as a third embodiment of the present invention according to FIGS. 10 through 14.

Referring to FIG. 10, a platen 114 for feeding a printing paper (not shown) is rotatably installed in a frame 112 of an electronic typewriter 110. A carriage 116 supported on a guide shaft 115 is provided movably back and forth along the longitudinal direction of the platen 114. The carriage 116 has a printing mechanism thereon which mainly consists of a type wheel 120, a printing hammer 122 and a ribbon cassette 124. An exposed length of a printing ribbon 126 running through the ribbon cassette 124 faces the platen 114.

The carriage 116 is connected with a wire 132 disposed between a right pulley 128 attached on the shaft of a stepping motor 118 and a left pulley 130. Therefore, the carriage 116 is movable back and forth along the longitudinal direction of the platen 114 by means of the reversible stepping rotation of the stepping motor 118. The upper front surface of the frame 112 is provided with a keyboard 134 having a multiplicity of keys 133 thereon. In the rear of the keyboard 134, a rectangular opening 135 is provided over the platen 114 and the movable range of the carriage 116. A lid 136 operatively covers the opening 135. A display device 144 such as a liquid crystal display is provided between the opening 135 and the keyboard 134 on the frame 112 so as to display various information and instruction for an operator.

A first position P1, for detecting the carriage 116 at the original position, is located outside the printing range near the left end of the platen 114 in the frame 112. A detector switch mechanism 138 shown in FIG. 11 is attached near both the first position P1 and a second position P2 where the lid 136 is detected to be opened or closed. The detector switch mechanism 138 can detect if the carriage 116 has been moved to the first position P1 and also detect if the lid 136 is open or closed. The detector switch mechanism 138 has a pair of strips, that is, a first strip 140 and a second strip 142, which are made of flexible metal such as phosphor bronze. Contacts 140*a* and 142*a* are formed at each opposing surface of the strips 140 and 142 respectively. A branch 140*b* of the first strip 140 projects from the first strip 140 in the vertical direction thereof and extends across and below the second strip 142. When the carriage 116 is brought into contact with the branch 140*b*, the first strip 140 is pressed away from the second strip 142.

When neither of the strips 140 nor 142 is subjected to an external force, namely, when the lid 136 is open and the carriage 116 is away from the original position, the detector switch mechanism 138 is in such a state as shown in FIG. 12B. In other words, the first strip 140 extends straight and the second strip 142 is held away from the first strip 140. Accordingly the contacts 140*a* and 142*b* are kept open. When the lid 136 is closed, on the other hand, a projection 136*a* projecting from the back surface of the lid 136 comes into contact with the second strip 142 at the second position P2, as shown in FIG. 12A. As a result, the second strip 142 is bent toward the first strip 140 so as to close the contacts 140*a* and 142*a*. When the carriage 116 is moved to the first position P1 with the lid 136 closed, a projection 116a attached on the carriage 116 presses the branch 140*b* of the first strip 140 so as to open the contacts 140*a* and 142*a*, as shown in FIG. 12C.

FIG. 13 is a block diagram of an electric control system in the electronic typewriter 110 in the third embodiment. A central processing unit (CPU) 146 is connected with a read only memory (ROM) including a program memory 148. Receiving signals from the detector switch mechanism 138 or from the keyboard 134, the CPU 146 controls the carriage driving device including the stepping motor 118 according to a definite program and gives an appropriate display to the display device 144.

The functions of the electronic typewriter 110 embodying the present invention will be described hereinafter referring to the flow chart shown in FIG. 14. After the electronic typewriter 110 is turned on, it is determined at decision point S1 whether the contacts 140*a* and 142*a* of the detector switch mechanism 138 are closed. If the answer is NO, that is, the contacts 140*a* and 142*a* are open, the CPU 146 rotates the stepping motor 118 according to the control program in order to move the carriage 116 rightward for a determined distance at step S22. At decision point S23 it is determined again whether the contacts 140*a* and 142*a* of the detector switch mechanism 138 are closed. If the answer is NO again, a message such as"COVER OPEN" is displayed on the display device 144 at step S24 and the program thereafter returns to decision point S23. When the lid 136 is closed after step S24, the projection 136*a* of the lid 136 presses the second strip 142 toward the first strip 140 at the second position P2 so as to close the contacts 140*a* and 142*a* of the detector switch mechanism 138. As a result, determining YES at decision point S23, the program then proceeds to step S25 where the message on the display device 144 is turned off, and then proceeds to step S26. Conversely, if the answer is YES at decision point S21, i.e., the contacts 140*a* and 142*a* are closed, the program proceeds directly to step S26. Thereafter, the CPU 146 starts the detection of the carriage original position as follows.

At step S26 the carriage 116 is moved leftward so as to press the branch 140*b* of the first strip 140 by the projection 116*a* attached on the carriage 116 until it is determined at the following decision point S27 that the contacts 140*a* and 142*a* are open, as shown in FIG. 12C. Here, it is detected that the carriage 116 is located at the original position. At the following step S28, the CPU 146 outputs a stop command to the stepping motor 118 to stop the carriage 116 according to the program stored in the program memory 148. At step S29, the CPU 146 commands the stepping motor 118 to rotate so that the carriage 116 is moved rightward for a determined distance and stopped at the home position HP within the printing range. As a result of the movement of the carriage 116 to the home position HP, the branch 140*b* of the first strip 140 is released from the press by the projection 116a of the carriage 116 so as to close the contacts 140*a* and 142*a* of the detector switch mechanism 138. At decision point S30 it is determined again whether the contacts 140*a* and 142*a* are closed. If the answer is YES, the CPU 146 determines that printing is possible.

When the lid 136 is opened while the carriage 116 is on standby for printing at the home position HP, the contacts 140*a* and 142*a* of the detector switch mechanism 138 are opened. In such a case, it is determined NO at decision point S30. Thus, the program proceeds to step S24 where a message such as "COVER OPEN" is displayed on the display device 144 and the CPU 146 determines that printing is impossible. If the lid 136 is closed after step S4, it is determined YES at decision point S23 since the contacts 140*a* and 142*a* are closed again as shown in FIG. 12A. At the following step S25 the message on the display device 144 is turned off, and then the program proceeds to steps S26 through S30 where the CPU 146 determines that printing is possible.

Obviously, many modifications and variations of the present invention are possible with regard to the above teachings. It is therefore to be understood that within the scope of the appended claims, the invention may be practiced other than as specifically described.

What is claimed is:

1. A typewriter with a keyboard, a frame, a carriage relatively movable along a platen installed in the frame, and a lid for operatively covering the frame, comprising:

a detector switch provided on the frame alternatively being in a first state or a second state;

a first stimulator provided on the lid for changing the detector switch to the first state when the lid is closed and for changing the detector switch to the second state when the lid is opened;

a second stimulator provided on the carriage, and being shiftable between a normal rest position and a shifted position, for changing the detector switch to the second state when the carriage is at an original position along the platen and the second stimulator is in the shifted position and for changing the detector switch to the first state otherwise; and means for shifting the second stimulator from the normal rest position to the shifted position if the detector switch is in the first state after the typewriter is turned on or when the lid is closed after once opened.

2. A typewriter according to claim 1, wherein the carriage has a ribbon lift mechanism, the second stimulator is attached on the ribbon lift mechanism, and the shifting means is the ribbon lift mechanism.

3. A typewriter according to claim 2, wherein the carriage is moved to a preset memorized position if the detector switch is changed from the first state to the second state when the second stimulator is shifted to the shifted position.

4. A typewriter according to claim 2, wherein the carriage is moved to a central portion along the platen when the typewriter is operated and the detector switch is changed from the first state to the second state.

5. A typewriter according to claim 1, wherein the carriage has a correction ribbon lift mechanism, the second stimulator is attached on the correction ribbon lift mechanism and the shifting means is the correction ribbon lift mechanism.

6. A typewriter with a keyboard, a frame, a carriage relatively movable along a platen installed in the frame, and a lid for operatively covering the frame, comprising:

a detector switch provided on the frame alternatively being in a first state or a second state;

a first stimulator provided on the lid for stimulating the detector switch to the first state when the lid is closed;

a second stimulator provided on the carriage for stimulating the detector switch to the second state when the carriage is at a preset original position along the platen; and means for moving the carriage to a position where the second stimulator cannot stimulate the detector switch to the second state when the detector switch is stimulated to the second state after the typewriter is turned on.

7. A typewriter according to claim 6, wherein the carriage is moved to a central portion along the platen when the typewriter is operated and the detector switch is changed from the first state to the second state.

8. A typewriter according to claim 6, wherein any key on the keyboard is inoperable when the typewriter is operated and the detector switch is changed from the first state to the second state.

9. A typewriter with a keyboard, a frame, a carriage relatively movable along a platen installed in the frame, and a lid for operatively covering the frame, comprising:

a detector switch provided on the frame for indicating both whether the lid is open and whether the carriage is at an original position along the platen;

means for distinctively detecting a lid open condition and an original position condition with said single detector switch;

wherein said means for distinctively detecting comprises:

a first stimulator provided on the lid;

a second stimulator provided on the carriage; and means for shifting the second stimulator from a rest position to a position in which the second stimulator may stimulate the detector switch.

10. A typewriter with a keyboard, a frame, a carriage relatively movable along a platen installed in the frame, and a lid for operatively covering the frame, comprising:

a detector switch provided on the frame for indicating both whether the lid is open and whether the carriage is at an original position along the platen;

means for distinctively detecting a lid open condition and an original position condition with said single detector switch;

wherein said means for distinctively detecting comprises:

a first stimulator provided on the lid;

a second stimulator provided on the carriage; and means for moving the second stimulator to a position where the second stimulator cannot stimulate the detector switch.

11. A typewriter according to claim 10, wherein the means for moving the second stimulator to a position where the second stimulator cannot stimulate the detector switch comprises means for moving the carriage.

* * * * *